US007735348B2

(12) United States Patent
Sawitzki et al.

(10) Patent No.: US 7,735,348 B2
(45) Date of Patent: Jun. 15, 2010

(54) METHOD AND BENDING PRESS FOR BENDING BOUNDARY EDGE OF A SHEET FOR SHAPING INTO AN OPEN SEAM TUBE

(75) Inventors: Manfred Sawitzki, Mettmann (DE); Johannes Gross-Weege, Krefeld (DE); Wolfgang Hartjenstein, Ratingen (DE); Ludwig Oesterlein, Mülheim (DE); Manfred Lenuck, Mülheim (DE)

(73) Assignee: Euroipe GmbH, Mulheim a.d. Ruhr (DE)

( * ) Notice: Subject to any disclaimer, the term of this patent is extended or adjusted under 35 U.S.C. 154(b) by 290 days.

(21) Appl. No.: 11/665,419

(22) PCT Filed: Oct. 10, 2005

(86) PCT No.: PCT/DE2005/001834

§ 371 (c)(1),
(2), (4) Date: May 7, 2007

(87) PCT Pub. No.: WO2006/039916

PCT Pub. Date: Apr. 20, 2006

(65) Prior Publication Data

US 2007/0261464 A1 Nov. 15, 2007

(30) Foreign Application Priority Data

Oct. 14, 2004 (DE) ..... 10 2004 050 784

(51) Int. Cl.
*B21D 11/00* (2006.01)

(52) U.S. Cl. ..... 72/319; 72/316; 72/388; 72/51

(58) Field of Classification Search ..... 72/312, 72/313, 316, 318, 319, 320, 387, 388, 48, 72/51, 52, 298, 301, 303, 308, 310, 311, 72/457, 458

See application file for complete search history.

(56) References Cited

U.S. PATENT DOCUMENTS 1,777,351 A * 10/1930 Carlson ..... 72/368
2,060,690 A * 11/1936 Richard ..... 72/313
2,636,253 A * 4/1953 Rees ..... 72/48
2,938,413 A * 5/1960 Pauls ..... 72/479

(Continued)

FOREIGN PATENT DOCUMENTS

BE 852666 A1 9/1977

(Continued)

*Primary Examiner*—Edward Tolan
(74) *Attorney, Agent, or Firm*—Duane Morris LLP

(57) ABSTRACT

The invention relates to a method and a bending press for bending the boundary edge of a planar sheet for shaping into an open seam tube, with an upper tool shaped to correspond to the bend radius to be achieved and an opposed lower tool which may be displaced vertically, between which the boundary edges of the sheet which is clamped in place in the press frame may be bent into the desired boundary contour. The lower tool is provided with a straight working surface and mounted to pivot about a rotational axis whereby the pivot range is at least so large that a permanent planar contact between the working surface of the lower tool and the bottom face of the boundary edge is possible during the bending.

20 Claims, 2 Drawing Sheets

U.S. PATENT DOCUMENTS

| | | | | | |
|---|---|---|---|---|---|
| 3,400,568 | A | * | 9/1968 | Brandner | 72/310 |
| 3,983,735 | A | * | 10/1976 | Berry | 72/312 |
| 3,994,152 | A | * | 11/1976 | Wolters | 72/315 |
| 4,002,049 | A | * | 1/1977 | Randolph, Sr. | 72/388 |
| 4,045,993 | A | * | 9/1977 | McCauley | 72/387 |
| 4,430,872 | A | * | 2/1984 | Mihara et al. | 72/51 |
| 4,565,084 | A | * | 1/1986 | Jonsson | 72/387 |
| 4,739,642 | A | * | 4/1988 | Redman | 72/306 |
| 5,404,742 | A | * | 4/1995 | Wilson et al. | 72/387 |
| 5,765,427 | A | * | 6/1998 | Codatto | 72/307 |
| 6,272,893 | B1 | * | 8/2001 | Kleinburger et al. | 72/16.2 |
| 6,604,395 | B2 | * | 8/2003 | Lee | 72/37 |

FOREIGN PATENT DOCUMENTS

| | | | |
|---|---|---|---|
| DE | 2510488 | A1 | 9/1976 |
| DE | 2641573 | A1 | 3/1978 |
| DE | 3105351 | A1 | 12/1981 |
| DE | 4311228 | A1 | 10/1994 |
| GB | 1537055 | A | 12/1978 |
| JP | 55064930 | A | 5/1980 |

* cited by examiner

METHOD AND BENDING PRESS FOR BENDING BOUNDARY EDGE OF A SHEET FOR SHAPING INTO AN OPEN SEAM TUBE

CROSS-REFERENCES TO RELATED APPLICATIONS

This application is a national stage application of co-pending PCT Application No. PCT/DE2005/001834 filed Oct. 10, 2005, which claims priority to German application no. DE 10 2004 050 784.8 filed on Oct. 14, 2004.

BACKGROUND OF THE INVENTION

The present invention pertains to a method for bending a sheet for shaping into an open seam tube.

BRIEF SUMMARY OF THE INVENTION

During the bending of a planar sheet which shall be shaped into an open seam tube according to the prior-art UOE method, the boundary edges of the sheet in the U press are not at all shaped into the circular shape of the finished tube and in the O press only with very great pressing pressure. Therefore, the boundary edges are usually first bent as much as possible into the circular shape in bending presses with various bending tools, wherein, in terms of production, the end areas of the boundary edges remain almost undeformed. These so-called ridges to be detected on the finished tube shall be kept as small as possible or avoided, since they can be corrected only at a great expense.

The parallel, opposing band edges in the open seam tube are usually provided with a corresponding band edge beveling (e.g., double V) depending on the sheet thickness for the subsequent straight bead welding.

The bending presses known according to the state of the art for bending the boundary edges of planar sheets consist of an upper tool shaped to correspond to the bend radius to be achieved and rigidly arranged in the press frame and an opposed lower tool, which may be displaced vertically.

Between the upper tool and lower tool is arranged the boundary edge of the sheet, which is clamped in place in the press frame, which may be bent into the desired boundary contour by means of a vertical movement of the lower tool in the direction of the upper tool.

Bending presses of this type, which deal with the problem of the undeformed end areas during the bending of the boundary edges of planar sheets, have become known, for example, from DE 26 41 573 A1, DE 43 11 228 A1 or DE 25 10 488 C.

One drawback in these prior-art presses is that the bevels located on the sheet edges are plastically deformed during the bending in association with the method, from which intolerable wall thickness lower deviations may arise. Partly due to the occasionally highly pronounced deformations, these band edge defects cannot be covered with certainty even by subsequent welding. This causes time-consuming and expensive reworking of the defective tubes.

Extensive investigations about this problem have led to the discovery that these deformations in the prior-art presses are caused by the fact that the bending operation is started via a linear introduction of force of the lower tool into the band edges, wherein if the elasticity limit of the steel is exceeded, plastic deformations, i.e., deformations of the band edge are caused. This effect increases with increasing sheet thickness and/or higher steel strengths.

Partly due to the vertical motion of the lower tool in the direction of the upper tool, for example, the risk of deformation of the band edges is especially high in the upper tool which has a convex design and the lower tool which has a corresponding concave design, especially at the beginning of the bending, because a great angular difference between the lower tool contour and the sheet contour occurs in this phase in relation to the method. In addition, due to the linear introduction of force by the lower tool into the sheet edge, the local stress peaks in the beginning phase are very high.

Moreover, the investigations also showed that these local stress peaks become lower during the bending operation, since the lower tool comes closer and closer to the contour of the boundary edge following the upper tool and finally the linear contact turns into a planar contact.

To minimize the formation of ridges, an attempt was made according to DE 23 65 515 A1 to guide the boundary edges through upper and lower bending rollers, whose respective convex and concave circumferential contours correspond to the radius of the edge areas to be bent.

Apart from the considerable cost of constructing such a bending means, which works in two stages, a linear introduction of force at the band edge at the beginning of the shaping can also herewith be avoided.

Another drawback lies in the fact that a flaring of the sheet edges cannot be prevented due to the rolling deformation of the boundary edges, and consequently, ripples form in the edge area.

Furthermore, it is a drawback that the bend radius of the boundary edge is set by the circumferential contours of the bending rollers. This means that in case of changing tube diameters a corresponding number of bending rollers with different circumferential contours must be made available.

Therefore, the object of the present invention is to provide a method for bending a planar sheet for shaping into an open seam tube in a bending press, whereby plastic deformations and/or crushing of the band edges prepared for welding can be avoided with certainty, resulting in lower deviations in wall thickness in the weld seam area of the finished tube. An application is also made possible for different tube diameters with reduced tool use.

According to the teaching of the present invention, a method, in which a planar contact of the working surface of the lower tool with the bottom face of the boundary edge is guaranteed already at the beginning of the bending operation, which is maintained during the entire bending operation, is used to accomplish this object. Advantageously, only the end area of the boundary edge is contacted in order to keep the area of the undeformed band edges as small as possible.

With this way of proceeding, the local stress peaks at the beveled sheet edge which otherwise occur at the beginning of the bending are avoided with certainty due to the planar contact, such that plastic deformations resulting from exceeding the local stress are ruled out. This advantageous way of proceeding is achieved by means of a combined motion of the lower tool, wherein the lower tool follows the contour of the upper tool by means of vertical displacement and simultaneous pivoting about a rotational axis and remains in planar contact with the boundary edge to be bent from the beginning of the bending.

According to a first embodiment, the rotational axis may be located within the lower tool, and the pivoting may take place, for example, about a pin rotatably mounted and arranged in the lower tool.

During the bending, a relative displacement between the boundary edge and the working surface of the lower tool occurs kinematically to a limited extent, which leads to a displacement of the point of application of forces away from the band edge. Depending on the band thickness and the material the undeformed end area of the boundary edge may occasionally be slightly increased thereby.

If this effect is to be absolutely avoided in the design of the bending press, the rotational axis according to an advantageous variant is located in the contact plane between the working surface of the lower tool and the bottom face of the boundary edge.

In this case, the lower tool is pivoted about a defined point of contact (rotational axis) in relation to the lower tool during the entire bending operation, following the contour of the upper tool.

This pivoting may be embodied, for example, in that the lower tool is mounted to pivot in a mount with a dome-shaped design.

In this mount, the point of application of force of the lower tool is set by means of the central point of the dome diameter. During the bending of the boundary edge, the point of application of force is now displaced corresponding to the bending contour of the boundary edge on the sheet edge slightly outwards, which results in the undeformed area of the boundary edge being advantageously further reduced.

Besides the dome-type mount, still other types of mounts are conceivable, wherein it is especially essential for the lower tool to be designed simultaneously to be able to be displaced vertically and to be able to pivot in such a way that a planar contact takes place during the entire bending.

Another essential advantage of the method according to the present invention consists in the fact that only one other corresponding lower tool must be supplied to produce different bend radii.

The lower tool according to the present invention no longer needs to be replaced, since it automatically follows the respective contour of the upper tool corresponding to the tube diameter. This saves considerable costs in acquisition, maintenance and mounting.

Further features, advantages and details of the present invention shall become evident from the following description of the exemplary embodiments shown.

DETAILED DESCRIPTION OF THE INVENTION

Figure 1A:
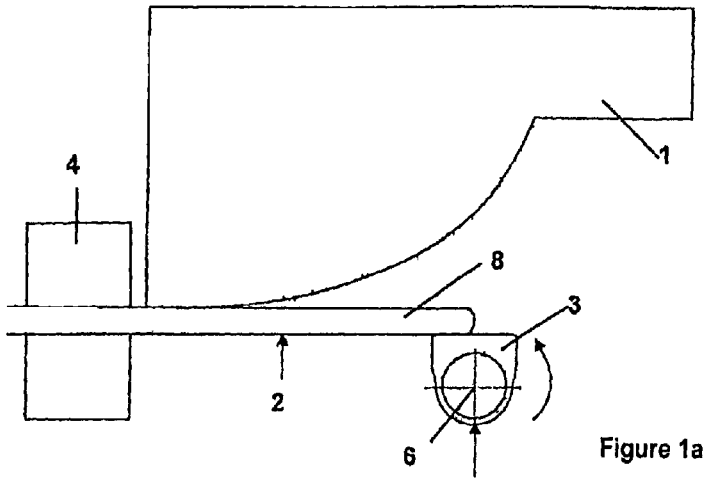
FIG. 1*a* shows a schematic diagram of a lower tool according to the present invention with a rotational axis within the tool immediately before the bending of a boundary edge.

FIG. 1*a* shows a schematic diagram of a first embodiment of a lower tool according to the present invention with a rotational axis within the tool immediately before the bending of a boundary edge.

For bending a boundary edge 2, a sheet is clamped in place in the press frame 4 of a bending press (not shown in detail) outside of the boundary edge area to be bent and positioned under an upper tool 1 shaped to correspond to the bend radius to be achieved.

The end area 8 of the boundary edge 2 to be bent is provided with a bevel 7 for welding the UOE-formed open seam tube.

A lower tool 3 according to the present invention is arranged under the end area 8 of the boundary edge 2 vertically displaceable and simultaneously mounted to pivot about a rotational axis 6.

According to the present invention, with the beginning of the bending operation the working surface of the lower tool 3 comes into planar contact with the bottom face of the boundary edge 2, and only a partial area of the working surface of the lower tool touches the bottom face of the boundary edge 2, since a relative displacement of the point of application of forces occurs during the bending, kinematically to a limited extent, in the contact plane between lower tool 3 and boundary edge 2

Figure 1B:
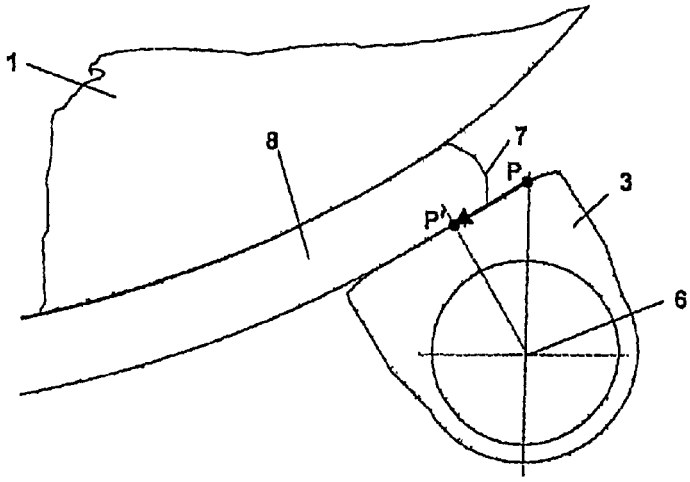
FIG. 1*b* shows, like FIG. 1*a*, but in the finished, bent state.

As shown in FIG. 1*b*, the lower tool 3 remains in permanent planar contact with the bottom face of the boundary edge 2 during the entire bending operation, partly due to the combined vertical and rotary motion of the lower tool 3. Consequently, linear stresses and stress peaks resulting therefrom with plastic deformations in the end area 8 of the boundary edge 2 and especially at the bevel 7 are avoided with certainty.

Because of the kinematics of the course of motion, a displacement takes place in the point of application of forces P→P' of the lower tool 3 at the bottom face of the boundary edge 2. The point of application of force is displaced corresponding to the current bend radius slightly away from the edge of the sheet 2.

Figure 2A:
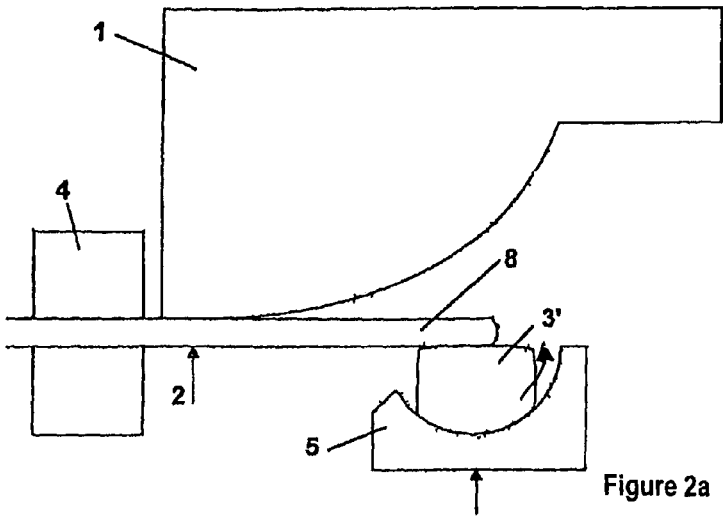
FIG. 2*a* shows, like FIG. 1*a*, but with a rotational axis in the lower tool-boundary edge contact plane.

FIG. 2*a* likewise shows a schematic diagram of another embodiment of a lower tool according to the present invention immediately before the bending of a boundary edge, but with a rotational axis in the lower tool-boundary edge contact plane.

Instead of the lower tool 3 shown in FIG. 1 with a rotational axis 6 within the lower tool, a tool 3' is now used, wherein the rotational axis 6' is located as the point of application of force P of the lower tool 3' in the contact plane between the working surface of the lower tool 3' and the bottom face of the boundary edge 2. In this case, the lower tool 3' is pivoted about this point of application of force P or P' (rotational axis 6') following the contour of the upper tool 1 during the entire bending operation.

According to the present invention, for this, the lower tool 3' is mounted to pivot in a tool mount 5 with a dome-shaped design, the point of application of force P or P' of the lower tool 3' in this mount being set by means of the central point of the dome diameter.

Figure 2B:
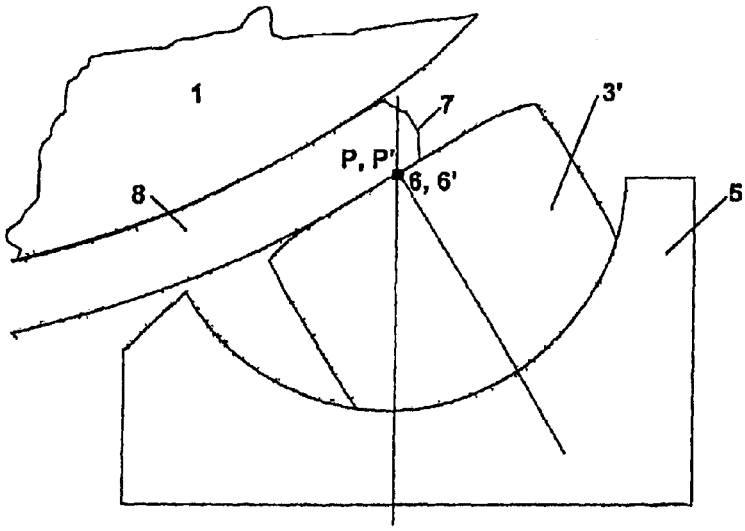
FIG. 2*b* shows, like FIG. 2*a*, but in the finished, bent state.

According to FIG. 2*b*, during the bending of the boundary edge 2, the lower tool 3' follows the contour of the upper tool 1 while maintaining the planar contact, as a result of which excess stresses or deformations especially at the bevel 7 of the boundary edge 2 are likewise advantageously avoided.

Moreover, in this type of mount the point of application of force P→P' of the lower tool 3' is displaced outwards corresponding to the actual bending contour on the sheet bottom face.

The result of this displacement is that the undeformed area of the boundary edge 2 is advantageously further reduced.

TABLE 1

List of Reference Numbers

| No. | Name |
|---|---|
| 1 | Upper tool |
| 2 | Boundary edge |
| 3, 3' | Lower tool |
| 4 | Press frame |
| 5 | Tool mount |
| 6, 6' | Rotational axis |
| 7 | Bevel |
| 8 | End area |
| P, P' | Point of application of force |

The invention claimed is:

1. A method for bending a planar sheet for shaping into an open seam tube in a bending press comprising:

a press frame;

a sheet, clamped in place in the press frame, the sheet further comprising a boundary edge having a bevel configured for welding to a correspondingly configured opposing second edge to form a longitudinal tube seam;

an upper tool, shaped to correspond to a bending contour to be achieved and rigidly arranged in the press frame;

a lower tool, which may be displaced vertically, opposed to the upper tool between which the boundary edge is bent into a desired boundary contour in one work step, wherein at a beginning of a bending operation, a bottom face of the boundary edge, which comes into contact with a working surface of the lower tool, comes into planar contact;

the planar contact being maintained during the entire bending operation by means of a combined motion of the lower tool comprising vertical displacement and simultaneous pivoting about a rotational axis.

2. The method of claim 1, wherein only an end area of the boundary edge is contacted over a surface during the entire bending operation.

3. A bending press for bending the boundary edge of a planar sheet to be shaped into an open seam tube, comprising:

a press frame;

a sheet, clamped in place in the press frame, the sheet further comprising a boundary edge having a bevel configured for welding to a correspondingly configured opposing second edge to form a longitudinal tube seam;

an upper tool, shaped to correspond to a bend radius to be achieved and rigidly arranged in the press frame;

a lower tool, which may be displaced vertically, opposed to the upper tool between which the boundary edge may be bent into a desired boundary contour, wherein the lower tool further comprises a working surface that is mounted to pivot about a rotational axis, wherein a pivot range is at least so large that a permanent planar contact between the working surface of the lower tool and a bottom face of the boundary edge is made possible during bending.

4. The bending press of claim 3, wherein the rotational axis is located within the lower tool.

5. The bending press of claim 4, wherein the lower tool is provided with a pin mounted in a rotational manner.

6. The bending press of claim 3, wherein the rotational axis, in relation to the working surface of the lower tool, is a fixed point of application of force on the bottom face of the boundary edge.

7. The bending press of claim 6, wherein the lower tool is mounted to pivot in a tool mount.

8. The bending press of claim 7, wherein the tool mount is dome-shaped.

9. The bending press of claim 3, wherein the bottom face of the boundary edge is flat and contacts a corresponding flat portion of the working surface to establish the planar contact therebetween during bending.

10. The bending press of claim 3, wherein the planar contact between the bottom face of the boundary edge and the working surface of the lower tool is maintained during the entire bending operation by means of a combined motion comprising linear displacement and simultaneous pivoting of the working surface about a rotational axis.

11. The bending press of claim 3, wherein the boundary edge has a bend radius conforming to the shape of the upper tool and the opposing second edge is formed with the same bend radius.

12. The bending press of claim 3, wherein the bottom face of the boundary edge is flat and contacts a corresponding flat portion of the working surface to establish the planar contact therebetween during bending.

13. The bending press of claim 3, wherein the vertical displacement of the lower tool is linear during the simultaneous pivoting of the lower tool about the rotational axis.

14. The bending press of claim 3, wherein the rotational axis is defined by a pivot pin disposed in the lower tool that is spaced apart from the working surface.

15. The bending press of claim 3, wherein the rotational axis is defined at the working surface.

16. A method for bending a planar sheet into a shape for forming an open seam tube to form a longitudinal seam welded in a bending press comprising:

providing a press frame;

clamping a flat work sheet comprising a boundary edge in the press frame;

positioning the boundary edge between an upper tool shaped to correspond to a bending contour to be achieved and a lower tool opposite the upper tool;

moving the lower tool in a linear vertical path towards the upper tool;

contacting a flat surface of the boundary edge with a flat working surface of the lower tool to establish planar contact therebetween;

continue moving the working surface towards the upper tool while maintaining planar contact between the flat surface of the boundary edge and the flat working surface; and bending the boundary edge on the upper tool to conform the edge to the shape of the upper tool.

17. The method of claim 16, wherein the planar contact is maintained between the flat surface of the boundary edge and the flat working surface by moving the working surface in a linear path towards the upper tool and simultaneously pivoting the working surface about a rotational axis.

18. The method of claim 16, wherein the boundary edge of the work sheet has a bevel configured for welding to a correspondingly configured opposing beveled second edge of the work sheet to form a longitudinal tube seam.

19. The method of claim 16, wherein the boundary edge has an arcuate shape after bending.

20. The method of claim 16, further comprising the boundary edge having a bevel configured for welding to a correspondingly configured opposing second edge to form a longitudinal tube seam.

* * * * *